US005177877A

United States Patent [19]

Duchesne et al.

[11] Patent Number: 5,177,877

[45] Date of Patent: Jan. 12, 1993

[54] DRYER-FUSER APPARATUS AND METHOD FOR HIGH SPEED ELECTROPHOTOGRAPHIC PRINTING DEVICE

[75] Inventors: Mark F. Duchesne, Dayton; Richard A. Gaspar, Centerville, both of Ohio

[73] Assignee: AM International, Inc., Chicago, Ill.

[21] Appl. No.: 754,246

[22] Filed: Aug. 26, 1991

Related U.S. Application Data

[63] Continuation of Ser. No. 457,317, Dec. 28, 1989, abandoned.

[51] Int. Cl.[5] ..... F26B 21/06

[52] U.S. Cl. ..... 34/51; 34/54; 34/16; 355/291

[58] Field of Search ..... 430/124, 126; 355/291, 355/286, 285; 35/51, 54, 16

[56] References Cited

U.S. PATENT DOCUMENTS

| | | | |
|---|---|---|---|
| 3,015,340 | 1/1962 | Montz et al. | 137/124 |
| 3,599,070 | 8/1971 | Davis et al. | 320/5 |
| 3,698,926 | 10/1972 | Furuichi | 117/17.5 |
| 3,736,103 | 5/1973 | Stibbe | 23/277 |
| 3,739,491 | 6/1873 | Creapo et al. | 34/156 |
| 3,776,440 | 12/1973 | Frost et al. | 226/97 |
| 3,873,013 | 3/1975 | Stibbe | 226/97 |
| 3,907,423 | 9/1975 | Hayashi et al. | 355/10 |
| 3,934,112 | 1/1976 | Lakhani | 219/216 |
| 3,942,266 | 3/1976 | Honjo et al. | 430/124 |
| 3,964,656 | 6/1976 | Hella | 226/97 |
| 4,021,586 | 5/1977 | Matkan | 427/17 |
| 4,052,959 | 10/1977 | Hayashi et al. | 118/644 |
| 4,116,620 | 9/1978 | Stibbe | 432/59 |
| 4,177,730 | 12/1979 | Schriber et al. | 101/248 |
| 4,182,472 | 1/1980 | Peekna | 226/97 |
| 4,197,971 | 4/1980 | Stibbe | 226/97 |
| 4,197,972 | 4/1980 | Daane | 226/97 |
| 4,197,973 | 4/1980 | Daane | 226/97 |
| 4,201,323 | 5/1980 | Stibbe et al. | 226/97 |
| 4,220,699 | 9/1980 | Ishida et al. | 430/126 |
| 4,265,384 | 5/1981 | Daane | 226/97 |
| 4,282,998 | 8/1981 | Peekna | 226/97 |
| 4,286,039 | 8/1981 | Landa et al. | 430/119 |
| 4,288,015 | 9/1981 | Curtin | 226/97 |
| 4,295,383 | 10/1981 | Frost | 474/83 |
| 4,310,238 | 1/1982 | Mochizuki et al. | 355/14 |
| 4,325,627 | 4/1982 | Suidler et al. | 355/10 |
| 4,343,769 | 8/1982 | Henkelmann | 422/109 |
| 4,369,584 | 1/1983 | Daane | 34/12 |
| 4,399,203 | 8/1983 | Bennett | 429/191 |
| 4,425,719 | 1/1984 | Klein et al. | 34/156 |
| 4,455,562 | 6/1984 | Dolan et al. | 346/154 |
| 4,462,169 | 7/1984 | Daane | 34/62 |
| 4,474,496 | 10/1984 | Rocheleau | 432/59 |
| 4,480,859 | 11/1984 | Rueckl et al. | 285/163 |

(List continued on next page.)

FOREIGN PATENT DOCUMENTS

| | | |
|---|---|---|
| 3838021 | 1/1989 | Fed. Rep. of Germany . |
| 2135242 | 8/1984 | United Kingdom . |

OTHER PUBLICATIONS

Japanese Patent Abstract No. 60-117278.

IBM Technical Disclosure Bulletin, vol. 32, No. 3A, Aug. 1989, pp. 266-271 "Fan Fold Solvent Vapor Fuser".

*Primary Examiner*—John Goodrow

*Attorney, Agent, or Firm*—Tarolli, Sundheim & Covell

[57] ABSTRACT

A dryer-fuser apparatus and method are provided to evaporate volatile, flammable carrier liquid from and to fuse solids color-imparting particles to a travelling web of paper in a high speed electrophotographic printing process. Volatiles from the dryer are vented to a catalytic converter, with heat recovered from the catalytic converter being recycled to supply heat to the dryer-fuser. An electric resistance heater may be used to supply heat during system start up and during such times when auxiliary heat is required. Regulation of the amount of venting is provided and is dependent upon the concentration of flammable volatiles present in the dryer.

17 Claims, 3 Drawing Sheets

U.S PATENT DOCUMENTS

| | | | |
|---|---|---|---|
| 4,482,624 | 11/1984 | Arney et al. | 430/138 |
| 4,515,292 | 5/1985 | Koos, Jr. | 222/52 |
| 4,538,899 | 9/1985 | Landa et al. | 355/10 |
| 4,563,086 | 1/1986 | Knapp et al. | 355/14 |
| 4,601,259 | 7/1986 | Yamashita | 118/658 |
| 4,631,244 | 12/1986 | Mitchell | 430/137 |
| 4,639,405 | 1/1987 | Franke | 430/124 |
| 4,698,767 | 10/1987 | Wensel et al. | 355/291 |
| 4,702,985 | 10/1987 | Larson | 430/115 |
| 4,734,737 | 3/1988 | Koichi | 355/14 |
| 4,760,423 | 7/1988 | Holtje et al. | 355/3 |
| 4,827,315 | 5/1989 | Wolfberg et al. | 346/160 |
| 4,828,956 | 5/1989 | Creatura et al. | 430/137 |
| 4,829,336 | 5/1989 | Champion et al. | 355/246 |
| 4,848,633 | 7/1989 | Hagen et al. | 226/97 |
| 4,860,924 | 8/1989 | Simms et al. | 222/56 |
| 4,942,676 | 7/1990 | Wimberger et al. | 34/51 |
| 4,959,693 | 9/1990 | Mitsuya et al. | 355/290 |

DRYER-FUSER APPARATUS AND METHOD FOR HIGH SPEED ELECTROPHOTOGRAPHIC PRINTING DEVICE

RELATED APPLICATION

This is a continuation of application Ser. No. 07/457,317 filed Dec. 28, 1989 now abandoned.

FIELD OF THE INVENTION

The present invention pertains to a high speed electrophotographic printing press and specifically to a dryer-fuser apparatus therefor which is utilized to evaporate toner carrier liquid from and fuse color-imparting toner solids particles to a travelling web or the like after the desired image has been transferred from an electrophotographic printing cylinder to the web.

BACKGROUND OF THE INVENTION

Electrophotographic printing is well known and has been widely refined. For example, today, almost every office and indeed some homes have electrophotographic copiers. The industry has grown to the point where it is now a highly competitive multi-billion dollar industry. In most instances, these home and office copiers are capable of providing only about a few copies per minute.

In electrophotography, images are photoelectrically formed on a photoconductive layer mounted on a conductive base. Liquid or dry developer or toner mixtures may be used to develop the requisite image.

Liquid toner dispersions for use in the process are formed by dispersing dyes or pigments and natural or synthetic resin materials in a low dielectric constant carrier liquid. Charge control agents are added to the liquid toner dispersions to aid in charging the pigment and dye particles to the requisite polarity for proper image formation on the desired substrate.

The photoconductive layer is sensitized by electrical charging whereby electrical charges are uniformly distributed over the surface. The photoconductive layer is then exposed by projecting or alternatively by writing over the surface with a laser, L.E.D., or the like. The electrical charges on the photoconductive layer are conducted away from the areas exposed to light with an electrostatic charge remaining in the image area. The charged pigment and/or dye particles from the liquid toner dispersion contact and adhere to the image areas of the photoconductive layer. The image is then transferred to the desired substrate, such as a travelling web of paper or the like.

In contrast to office and home copiers, high speed electrophotographic printing presses are being developed wherein successive images are rapidly formed on the photoconductive medium for rapid transfer to carrier sheets or the like travelling at speeds of greater than 100 ft./min. and even at speeds of from 300–500 ft./min. These high speed presses are capable of delivering 10 million copies per month with web or copy widths being on the order of 20 inches or greater.

In a high speed printing press, it is necessary that the image, after application of toner, be thoroughly fixed and dried prior to later (downstream) operations such as punching, perforating, rewinding, folding and/or sheeting in order that the final printed production is of requisite quality and press parts remain clean and free of toner which can mark the web. Furthermore, to dry and fuse a variety of different color toners efficiently, it is highly desirable to heat the travelling web, therefore volatilizing the dielectric carrier liquid and fusing the pigment and/or dye particles and associated synthetic resin binder to the web in such manner that image smearing is inhibited by minimizing contact of the travelling web surfaces with conveyor rollers and the like.

Further, due to the heat requirements of the drying process, and the attendant energy costs associated with same, it is highly desirable to provide a dryer-fuser apparatus that may successfully operate at high speed, while minimizing the energy input requirements for the heating process.

Due to the flammable nature of the dielectric carrier liquid utilized in such electrophotographic processes, it is highly desirable to provide a drying apparatus which maintains the drying atmosphere at a level that is substantially less than the lower flammability level of the carrier liquid. That is, at certain levels, the volatilized dielectric carrier liquid can provide a source of considerable danger in that in the presence of an external flame or spark the volatiles may ignite. For this reason, it is desirable to provide a dryer-fuser apparatus whereby fresh make-up air can be readily admitted to the drying zone so as to aid in maintaining the carrier liquid/atmospheric gas content well below that of the lower flammability level of the carrier liquid.

Further, it is desirable to provide a system to monitor the concentration of volatile carrier liquid in the dryer to control the rate at which the volatile gas containing atmosphere is exhausted from the apparatus in response thereto. At increasingly higher volatile levels, it is desirable to halt the travel of the web through the dryer altogether.

SUMMARY OF THE INVENTION

In accordance with the invention, a dryer-fuser apparatus and method are provided for utilization in a high speed electrophotographic printing process of the type adapted to operate at web speeds of 100 ft./min. and greater. More specifically, such high speed methods may operate at speeds of 300–500 ft./min.

The travelling web is forwarded by conveyor rolls or the like into a dryer housing that is provided with a pair of opposed hot air supply manifolds. Each manifold communicates with a plurality of air supply tubes that extend transversely across the web travel direction. The tubes are each provided with a plurality of apertures through which hot air passes to effect drying of the web. As the web travels through the dryer, it is interposed between the air supply tubes and held under tension by the rolls. The velocity of the hot air emanating from the tubes provides an air cushion for the web's travel through the dryer so that substantially no or little contact of the web is made with the air supply tubes during web travel through the dryer. As such, the web is suspended in the air cushion. Volatiles and hot air from the dryer housing are vented to a conduit in communication with a catalytic converter device.

As is known in the art, such catalytic converter devices comprise a fixed bed catalyst that supports exothermic degradation of the volatile organic compounds. The hot effluent gases emanating from the catalytic converter may then be either vented to exhaust or a portion thereof may be recycled to the air supply manifolds to provide heat for the drying process. The use of recycled heat from the catalytic oxidation of carrier liquid to dry and fix an image transferred to a copy sheet is not, in and of itself, new. For example, in conjunction with home and office type copiers, U.S. Pat. No. 4,538,899 discloses such methods and a device therefor.

In accordance with the invention, a portion of the recycled heat from the catalytic converter is returned to an upstream heat exchanger to heat the volatile materials and hot air vented from the dryer housing. In such manner, the volatiles and hot exhaust air emanating from the dryer housing may be preheated prior to their passage through the catalytic converter.

During system start up and for those times in which auxiliary heating means are required, an electrical resistance heater or the like may be used to supply heat to the dryer. A recycle bypass damper is also provided to regulate the amount of recycled heat from the catalytic converter that is recycled to the dryer.

A make-up air damper, in communication with a source of fresh make-up air, regulates the amount of fresh make-up air that is forwarded to the heater. The amount of make-up air admitted to the dryer is controlled by a pressure monitoring device that measures the pressure within the dryer.

An active flame sensor monitors the lower flammability level of the atmosphere within the dryer. In response to this sensor, the speed of the dryer exhaust fan is controlled so that the atmosphere is preferably maintained at or below about 25% of the lower flammability level (L.F.L.) for the particular carrier liquid that is used. At higher LFLs, the drive responsible for advancing the web through the dryer is stopped and an audible alarm is actuated.

The invention will be further described in conjunction with the following detailed description and the appended drawings.

Figure 1:
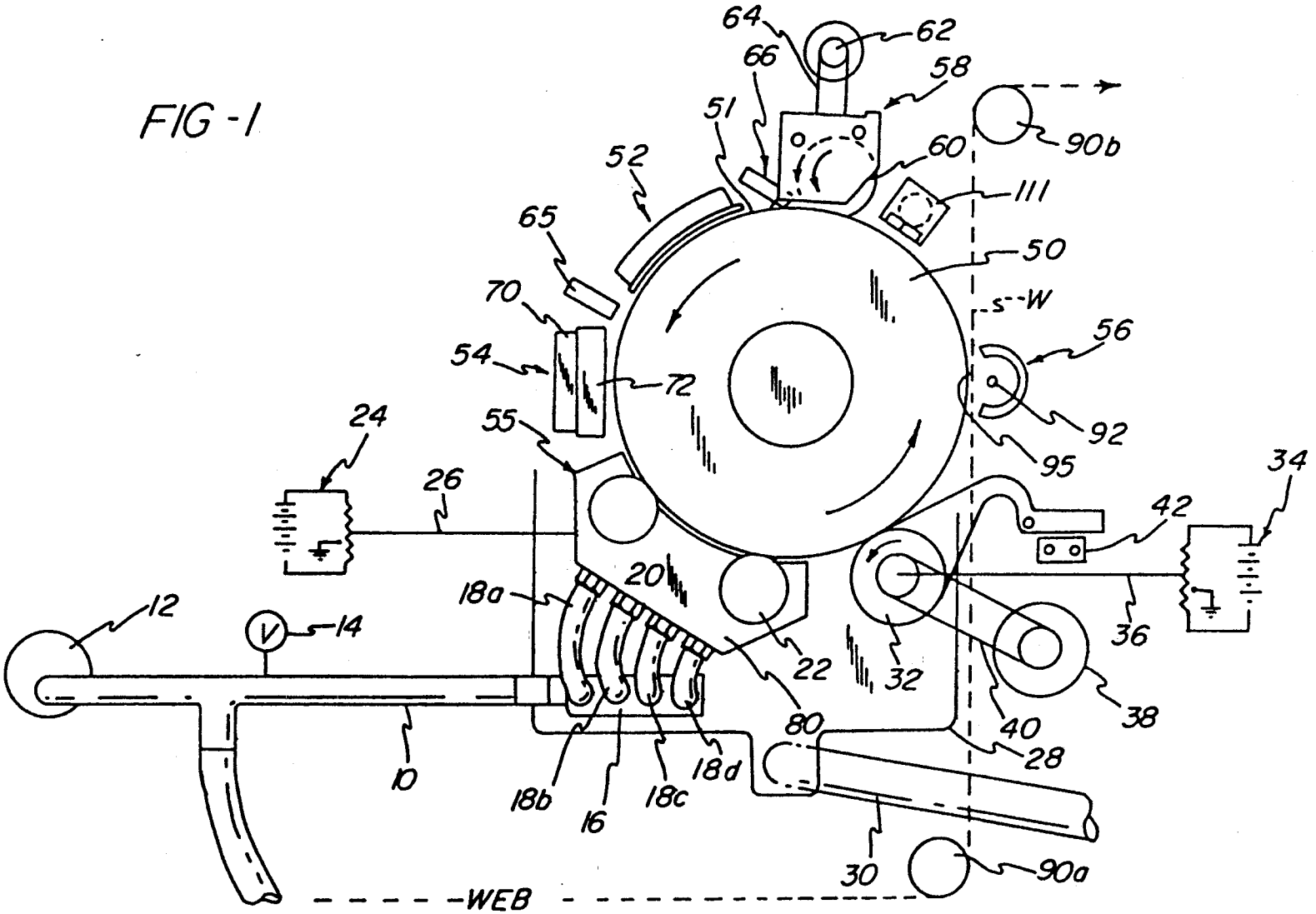
FIG. 1 is a schematic diagram showing the overall layout of components needed to form and develop the required image on the photoconductive cylinder surface and to transfer the developed image to a travelling web.

Turning first to the drawings and to FIG. 1 thereof, this view shows the overall organization of a typical photoconductive cylinder and associated mechanisms for formation of the latent electrostatic image, and subsequent image formation on the cylinder surface. A rotatable photoconductive drum 50, typically $As_2Se_3$, SeTe or others, rotates in a counterclockwise direction as indicated by the arrow shown on cylinder 50 in FIG. 1. Special systems are arranged sequentially around drum 50 as shown in FIG. 1, to accomplish the desired formation and transfer of images onto web w. These systems include a high intensity charging apparatus 52, exposing-discharging (or imaging) apparatus 54, developing apparatus 55, transfer apparatus 56 and cleaning apparatus 58. These assure that the drum surface is charged, exposed, discharged and cleared of residual toner, while the developed images are continually transferred to the web material w.

Charging apparatus 52 comprises a plurality of corona discharge devices comprising corona discharge wires disposed within appropriately shaped shielded members with each wire and associated shield member forming a separate focusing chamber. The charge imparted by the coronas to the photoconductive cylinder is on the order of at least +1000 volts d.c., preferably between +1000 and +1450 volts. These corona assemblies extend across the drum surface 51 and along an arc closely parallel to surface 51. In a successful embodiment using a drum having a 33-inch circumference (thus 10.504-inch diameter), the arcuate length of the charging unit is about 4.5 inches or somewhat greater than ⅛th of the drum circumference.

Proceeding counterclockwise around the drum (as viewed in FIG. 1), there is a charge potential sensor 65 (an electrometer) which senses the voltage at the surface 51 and provides a continuous feedback signal to a charging power supply (not shown) to thereby adjust the charge level of the photoconductor surface 51 regardless of variations due, for example, to irregularities in the power supply or changes in the peripheral velocity of drum 50.

Digital imaging device 54, in the form of relatively high intensity L.E.D. double row array 70 is mounted to extend transversely of the rotating drum surface 51. Each L.E.D. is individually driven from a corresponding driver amplified circuit, details of which need not be described herein. Light emitted from the L.E.D.s is in the range of 655–685 nm through a Selfoc lens 72 onto the drum surface 51 in a dot size of 0.0033 inch diameter. In one successful embodiment, there are a total of 6144 L.E.D.s in the array, divided between two rows which are spaced apart in a direction along the circumference of the surface by 0.010 inch and all fixed to a liquid cooled base block (not shown). The space between adjacent L.E.D.s in the same row is 0.0033 inch horizontally or transverse to the drum surface and the L.E.D. arrays in the two rows are offset horizontally by the same dimension, thus the L.E.D.s can cooperate to discharge a continuous series of dots across drum surface 51 at a resolution of 300 dots/inch.

Light from the L.E.D.s operates to discharge the background or non-image areas of the passing drum surface to a substantially lower potential, for example, in the order of +100 to +300 volts d.c. by exposing individual dot areas to radiation at a predetermined frequency, as mentioned, whereby the remaining or image areas comprise a latent electrostatic image of the printed portions of the form.

Although the use of an L.E.D. arrangement has been depicted herein as providing for the requisite image, other conventional means for forming the requisite image may also be utilized. For instance, laser printing and conventional exposure methods such as reflection from high contrast originals and projection through transparencies and the like may also be utilized, although they are not preferred.

The latent electrostatic image then is carried, as the drum rotates, past developing station 55 where it is subjected to the action of a special high speed liquid toner developer of the type comprising a dielectric carrier liquid material, such as the Isopar series of hydrocarbons, resinous binder particles, and color-imparting dye and/or pigment particles. As is known in the art, the desired charge may be chemically supplied to the resin-pigment/dye particles by utilization of well-known charge control agents such as lecithin and alkylated vinylpyrrolidone materials. In the embodiment shown, drum 50 comprises an $As_2Se_3$ photoconductive layer to which charge coronas 52 impart a positive charge. The toner particles are accordingly provided with a negative charge in the range of about 60 to 75 picamhos/cm.

The developing station 55 comprises a shoe member 80, which also functions as a developer electrode (which is electrically insulated from drum 50 and extends transversely across drum surface 51). The face of shoe member 80 is curved to conform to a section of drum surface 51 and, in a successful embodiment, has a length, along the arcuate face, of about 7 inches, slightly less than ¼ of the circumference of drum surface 51, and which is closely fitted to the moving drum surface, for example, at a spacing of about 500 microns (0.020 inch). Shoe 80 is divided into first and second cavities 82, 83 (see FIG. 5) through each of which is circulated liquid toner dispersion from a liquid toner dispersion supply and replenishment system.

Liquid toner dispersion is supplied to developer electrode 80 through conduit 10 via action of pump 12 and associated adjustable flow valve 14. The toner dispersion is fed to manifold 16 and then through inlet supply pipes 18(*a–d*). Polyurethane tires 20, 22 are journalled in the sidewalls of developer electrode housing and ride upon anodized rims that are circumferentially disposed about periphery of drum 50. A direct current source, indicated generally by the reference numeral 24, is provided to apply bias through conductor 26 to the electrode 80.

A toner sump 28 is provided to surround electrode 80 and is provided with a sump return line 30 to return spent toner dispersion to a liquid toner supply system (not shown).

The developer shoe 80 functions as an electrode which is maintained at a potential on the order of about +200 to 600 volts d.c. Thus, the negatively charged toner particles are introduced into the shoe cavities and are dispersed among electrical fields between: 1) the image areas and the developer electrode on the one hand and between 2) the background and the developer electrode on the other hand. Typically, the electrical fields are the result of difference in potential: a) between the images areas (+1000 to 1450 volts) and the developer electrode (+200 to +600 volts) which causes the negatively charged toner particles to deposit on the image areas, and b) the field existing between the background areas (+100 to +300 volts) and the developer electrode (+200 to +600 volts) which later field causes the toner particles to migrate away from the background areas to the developer shoe. The result is a highly distinctive contrast between image and background areas, with good color coverage being provided in the solid image areas. The tendency of toner particles to build up on the developer shoe or electrode is overcome by the circulation of the liquid toner therethrough at rates on the order of about 7.57 to 37.85 liters/min. (2 to 10 gallon/min.) back to the toner refreshing system.

As the drum surface passes from the developer shoe, a reverse rotating metering roll 32, spaced parallel to the drum surface by about 0.002–0.003 in., acts to shear away any loosely attracted toner in the image areas, and also to reduce the amount of volatile carrier liquid carried by the drum and any loose toner particles which might have migrated into the background areas. The metering role has applied to it a bias potential on the order of about +200 to +600 volts d.c. from d.c. power source 34 and conductor 36, varied according to web velocity. Reverse roll 32 is driven via drive roller 38 with drive being transmitted through belt or chain member 40. A position sensor 42 is provided to sense the position of roll 32 as shall be explained in greater detail hereinafter.

Proceeding further in the counterclockwise direction with regard to FIG. 1, there is shown a transfer apparatus 56 adapted to effect transfer of the image from the photoconductive surface to a travelling web w of paper or the like. A pair of idler rollers 90*a, b* guide web onto the "3 o'clock" position of drum 50 and behind the web path at this location is a transfer coratron 92. The web is driven at a speed equal to the velocity of drum surface 51 to minimize distortion of the developed image on the surface 51. The positioning of rollers 90*a*, b is such that the width (top to bottom) of the transverse band 95 of web-drum surface contact is about 0.5 inch centered on the radius of the drum which intersects the coratron 92.

The shape of the transfer coratron shield 96, and the location of the axis of the tungsten wire and shield 96 is such as to focus the ion "spray" from the coratron onto the web-drum contact band on the reverse side of web w. The transfer coratron 92 has applied to it a voltage in the range of +6600 to +8000 volts d.c., and the distance between the coratron wire 93 and the surface of web w is in the order of about 0.25–0.35 inch-preferably 0.317 inch. This results in a transfer efficiency of at least 95% of the solids particles of the liquid toner dispersion. Both solid toner particles and liquid carrier material are transferred to the web.

The web path continues into a fuser and dryer apparatus 100 (FIG. 2), wherein the carrier liquid is evaporated from the web material and the toner particles are fused thereto as shall be explained in greater detail hereinafter. Proceeding further in the clockwise direction with respect to FIG. 1, a cleaning apparatus 58 is utilized to remove all toner particles and carrier liquid from the drum surface 51 and erase lamp 111 is arranged to flood surface 51 with either blue or white light emanating from a fluorescent tube. Satisfactory cleaning results have been achieved with blue fluorescent tubes emitting predominantly at about 440 nm and with white fluorescent tubes emitting predominantly at 400, 440, 550 and 575 nm.

The foam roller 60 is of a polyurethane open cell construction and is fixed to a power driven shaft which is rotated in the opposite direction to drum surface motion, as indicated by the arrows in FIG. 1, so as to compress against and scrub the surface 51. The compression/expansion of the open cell foam during this action will tend to draw liquid carrier material and any included toner particles remaining on the surface 51 off of that surface and into the cells of roller 60.

A cleaning blade 66, comprising a tough, but flexible, polyurethane wiper blade is mounted with its edge extending forward and into contact with surface 51, just beyond foam roller 60. Blade 66 acts to wipe the drum surface 51 dry, since the photoconductor surface must be dry when it reaches the charging station.

Figure 2:
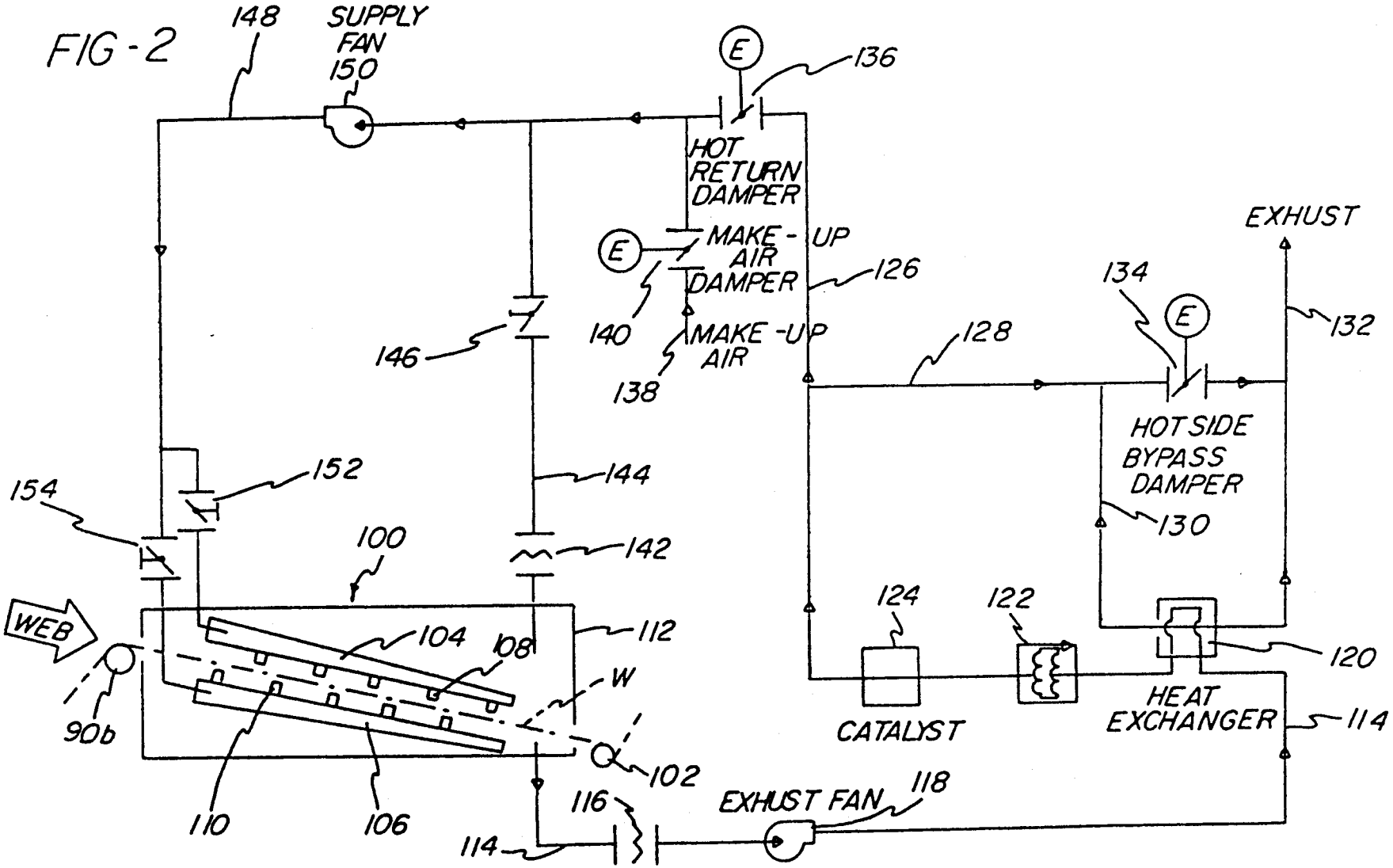
FIG. 2 is a schematic diagram of the dryer-fuser apparatus of the present invention.

Turning now to FIG. 2, it can be seen that web, w, is admitted into dryer-fuser apparatus 100, comprising housing member 112. The web is conveyed through the dryer-fuser by use of roller 90*b* and drive roller 102. As shown, the web is guided downwardly along an inclined path through the dryer-fuser. The dryer is designed to fuse toner on both sides of the web. In perfecting printing both sides of the web become "wet". Roller 90*b* has a surface made of expanded metal which presents a multitude of sharp points to support the web. The toned image only touches the this roll at discrete points each of minuscule size (or area) so the image is not disrupted. This is important in minimizing disturbance or distortion of the desired image. Air supply manifolds 104, 106 are provided with each carrying air supply tubes 108, 110 which tubes extend transversely across the surfaces of the web with the lower and upper array of tubes being offset from the other. As can be seen, the web is interposed between the surfaces of the tubes 108, 110 which are provided with a multiplicity of apertures therein to blow hot air onto the web from opposite sides thereof.

In accordance with the invention, the flow rate of hot air emanating from the air supply tubes 108, 110 is such as to provide an air cushion to cushion the web as it travels through the heater. In such manner, the web essentially floats through the heater while making little or no contact with surface portions thereof. Again, this tends to minimize smearing and image distortion that may otherwise occur during heating processes wherein the travelling web is contacted with roller and/or heater surfaces in the heater proper. Heated air at a temperature on the order of around 250° F. is ejected at 5,000 to 10,000 fpm from the air supply tubes as the surfaces of the moving web are transported at velocities in the range of from 100–500 ft./min. The hot air velocity is such that the web is kept spaced away from the nozzle arrays and follows a somewhat sinuous path between the manifolds 104, 106.

The hot air performs two functions. First, it volatilizes the liquid carrier material that has been applied to the travelling web. Secondly, it heats the web causing the solids toner particles to fuse onto the desired place on the web. In a typical operation, this requires sufficient heat transfer to remove and vaporize carrier liquid at rates of about 850 g/min. and higher. Volatiles and hot air in housing 112 are vented through conduit 114 and filter 116 by the action of downstream exhaust fan 118 thereon. The vented volatiles-hot exhaust air pass along conduit 114 to heat exchanger 120, the function of which shall be explained hereinafter.

During startup and at other times when auxiliary heating is required, an electrical resistance heater 122 is operated to provide supplementary heat through the conduits to supply manifolds 104, 106 through respective damper members 152, 154. Proceeding further in a downstream direction, the volatiles and hot air enter catalytic converter 124 wherein, in conventional manner, the volatile organic materials are exothermically converted into carbon dioxide and water whereby hot effluent exhaust air from catalytic converter 124 is passed to recycle line 126. A portion of the hot effluent air from the catalytic converter is diverted into bypass conduit 128 and heat exchanger flow line 130 whereby it heats the vented volatiles-hot air in conduit 114 to preheat the volatiles and exhaust air from dryer 112 prior to admission thereof into the catalytic converter means 124. The portion of heated effluent from catalytic converter 124 channeled through the heat exchanger is then conducted to exhaust port 132. A damper means or the like, 134, is provided in the bypass conduit line 128 so as to regulate back pressure in the system and to aid in regulating the amount of hot effluent air from the catalytic converter 124 that is passed through heat exchanger 120.

As is readily apparent, a portion of the hot effluent air from catalytic converter 124 is conducted through recirculator conduit 126 and is returned via the action of supply fan 150 and conduit 148 through either damper 152 or 154 to supply hot air to the air manifolds 104, 106. This is an important part of the invention in that, after the initial heat required for the process is provided by resistance heater 122, the resistance heater 122 can be turned off with heat supplied to the dryer 100 being composed entirely of heat emanating from catalytic converter 124 through recycle conduit lines 126 and 148. A return line damper 136 is used to regulate the amount of this recycled heat that is supplied to the manifolds 104, 106.

A fresh make-up air source 138 is provided in conjunction with damper means 140 to regulate the amount of fresh make-up air drawn by supply fan 150 through conduit 148 through either damper 152, 154 to the manifolds 104, 106. If desired, direct exhaust from housing 112 may be drawn through filter 142 and conduit 144 to and through conduit 148 to recycle exhaust air (including volatiles) to the air manifolds 104, 106, primarily during start-up. The amount of thus recycled exhaust air is regulated by means of a damper 146.

It has been found that heat from the catalytic converter effluent air, once the system has been brought to operate within a range of normal speeds, is sufficient to continue the recirculation, heating and filtering of the dryer-fuser air without the continued use of heater 122, which can then be switched off. The fuser-dryer apparatus thus is a recuperative system which effectively controls emissions from vaporization of the carrier liquid and recovers the resulting heat to further the fusing and drying process.

The roller 102 is chilled by internal cooling means and serves to reduce the temperature of the web material to approximately ambient. Downstream from this chilled drive roll 102, a plurality of other operations such as punching, perforating, rewinding, folding, sheeting, etc., may be performed on the travelling web in accordance with well-known techniques. Details of such additional operations may be gleaned from U.S. Pat. No. 4,177,730, the content of which is herein incorporated by reference.

Based upon preliminary data, typical operating parameters of the dryer-fuser system of the invention include a temperature on the web surface of about 250° F. during travel thereof through the dryer-fuser apparatus 100. The temperature of the heat/exchanger output is about 500° F.

Due to the flammable nature of the ISOPAR carrier liquid, it is highly desirable to perform the heating-fusing operation in such manner that the content of volatile material is maintained well below the lower flammability level of same. To this end, the dryer-fuser is adapted to operate at a level of 25% of the LFL (lower flammability level) of the carrier liquid or lower. Variables important in maintaining such atmosphere are the minimum flammable vapor concentration of Isopar in air, web speed, solvent content of the traveling web, amount of fresh make-up air admitted to the system and the amount of return volatiles and hot air recycled to the heater through line 144 and damper 146.

One of the advantages of the use of a hot air dryer as described and claimed herein over other dryers, such as microwave dryers, is that a variety of different toners may be dried. For instance, certain microwave dryers rely upon energy at a particular wavelength. However, in the present invention, the travelling web is heated with heat transfer from the web to the toner being used to fuse the toner particles.

Figure 3:
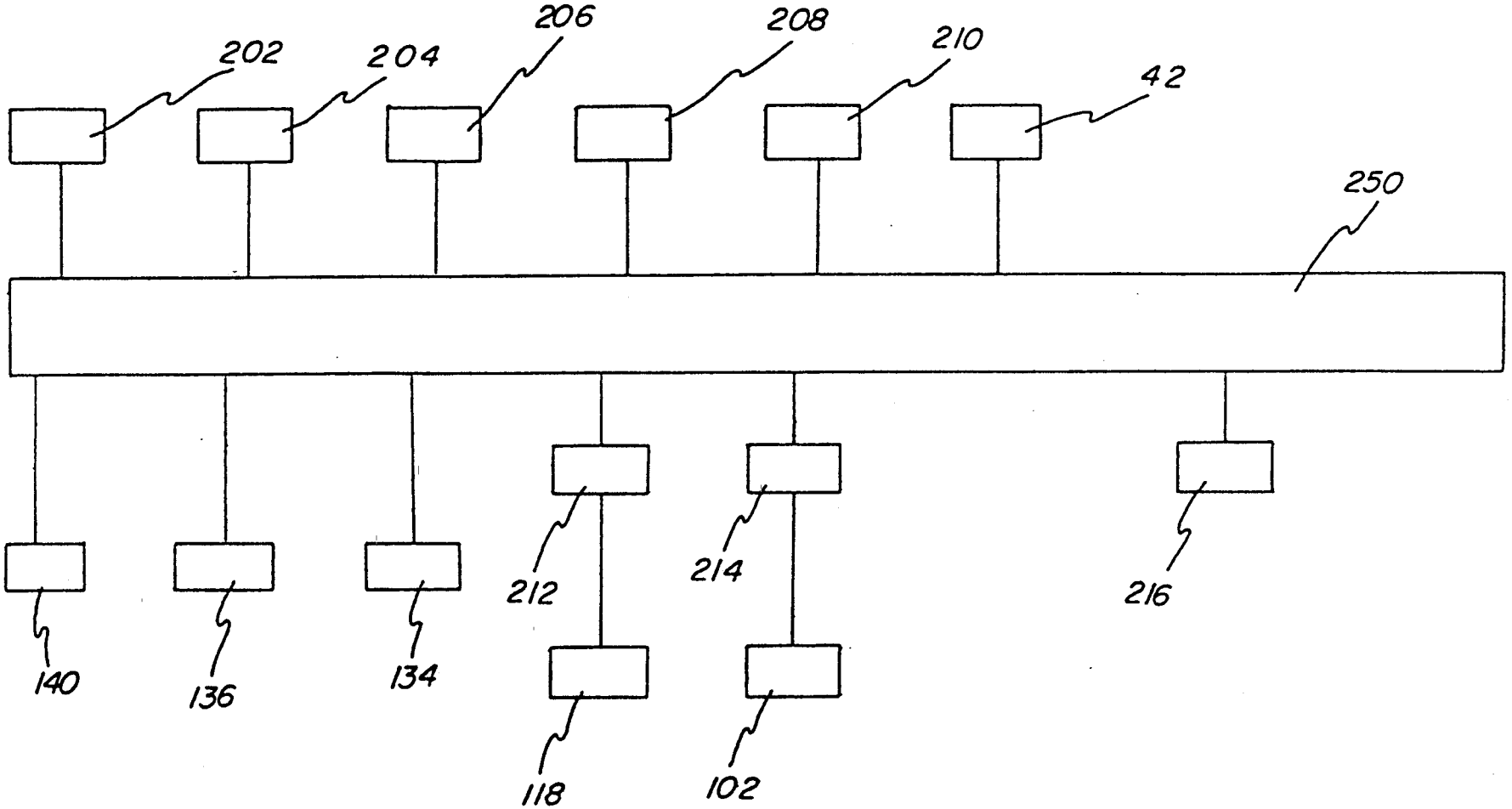
FIG. 3 is a control diagram showing the particular means for sensing and controlling various aspects of the dryer-fuser.

Turning now to FIG. 3, there is shown, in block format, a simplified control system schematic for the apparatus. A pressure monitoring device 202, such as a diaphragm containing pressure switch is contained within the dryer-fuser apparatus 100. Desirably, the pressure in the apparatus 100 is maintained at $-1''$ $H_2O$. The information from the pressure monitor 202 is forwarded to a programmable logic controller (PLC) 250 that compares the measured pressure with a desired set-point pressure which, in this instance, is $-1''$ $H_2O$. If the pressure is less than the desired set point (i.e., too much negative pressure in the fuser-dryer), the PLC sends an analog signal to adjustably open the make-up air damper 140 to in turn allow fresh make-up air to be supplied to the damper members 152, 154. Conversely, if the pressure exceeds the desired set point, the damper 140 is closed.

The opening or closing of hot air return damper 136 is similarly controlled by the PLC 250. Here, when the printing press is running, the temperature of the web exiting the dryer-fuser is measured by a thermocouple 204 or the like. This temperature information is supplied to the PLC 250 wherein it is compared to a predetermined set-point here, for example 220° F. If the indicated temperature is greater than this desired set-point, the PLC sends an analog signal to the adjustable air return damper 136 to close same to prevent air from the catalytic converter from entering the conduit 148 for recycled use in the fuser-dryer. In contrast, if the web temperature is below the predetermined set-point, the damper 136 is opened to allow recycling of the air emanating from the catalytic converter 124.

When the printing press is not running, a thermocouple 206 measures the temperature within the fuser-dryer 100. This temperature information is supplied to PLC wherein it is compared to a predetermined set-point, for example, 350° F. Again, if the measured temperature exceeds this set point, the damper 136 is closed preventing communication between duct sections 126 and 148. If the measured temperature is below the set-point, the damper 136 is opened.

Temperature control of the hot-side bypass damper 134 is also provided. A thermocouple or like device 208 is located just upstream from the catalytic converter 124. This temperature information is conveyed to the PLC where it is compared to a predetermined setpoint range. Here, for example, if the measured temperature is less than about 450° F., the PLC transmits an analog signal to the damper controller to close the bypass damper 134 to ensure that all hot air travelling through duct 128 is diverted through heat exchanger flow line 130. Conversely, if the temperature information sent to PLC by thermocouple 208 exceeds the high end of the set-point range, for example, 550° F., the bypass damper 134 is opened, thereby ensuring that a portion of the air passing through duct line 128 will pass directly through the damper 134 to exhaust 132 without travel through heat exchanger flow line 130.

Most importantly, due to the highly flammable nature of the carrier liquid utilized in the liquid toner dispersion formulations, a control system is provided to monitor and regulate the percent of carrier liquid concentration in the dryer-fuser atmosphere. To this end, a lower flammability limit (LFL) monitor 210 is positioned within the housing of the dryer-fuser. The preferred monitor 210 is the Model FFA "Sensing Flame Detection System" available from Control Instruments Corporation, Fairfield, N.J. This device comprises an active sensing flame. Flammable vapors that enter the device are incinerated by the flame. This action results in an increase in the BTU output of the flame which is measured by a resistance temperature detector which is then transmitted and indicated on a control module in terms of the LFL. This LFL signal is then used as input to the PLC 250. When the LFL value is greater than a predetermined low range set-point, for example, about 18%, the PLC sends an analog signal to a controller 212 which regulates (increases) the speed of the variable speed exhaust fan 118. If the LFL value exceeds an intermediate range set-point, for example, 25%, the PLC disconnects drive 214 for the chilled roll 102, thus stopping web travel through the dryer-fuser. An upper range LFL set-point, for example, 40% or 50%, may be set whereby in addition to actuation of the exhaust fan 118 and disconnection of drive for chill roll 102, audible alarm 216 is signalled.

Turning briefly to FIG. 1, sensor 42 monitors the position of reverse roller 32. When the reverse roller is not in its operative condition spaced closely adjacent to surface 51 so as to shear excess toner carrier liquid and solids particles from the surface, a signal is sent to PLC 250 (FIG. 3) to disconnect drive 214 for the chilled roll 102 to halt advancement of the web through the dryer.

Although this invention has been described with respect to certain preferred embodiments, it will be appreciated that a wide variety of equivalents may be substituted for those specific elements shown and described herein, all without departing from the spirit and scope of the invention as defined in the appended claims.

We claim:

1. In an electrostatic printing process of the type wherein a color imparting liquid toner dispersion comprising a volatile, flammable carrier liquid and solid color imparting toner particles is applied to a traveling web of paper or the like to form the desired image, a method of drying the web in a hot air dryer by evaporating the carrier liquid from the web and mixing the volatilized carrier with the hot air, comprising:

directing the web through the dryer;

supplying a stream of hot air into the dryer;

suspending the traveling web in a cushion of the hot air while passing the web through the dryer;

withdrawing the combined volatilized carrier and hot air from the dryer with a variable speed exhaust fan; and measuring the content of the variable speed exhaust fan in response to such measured content of carrier volatiles to control the amount of venting.

2. The process defined in claim 1 further comprising passing the mixed vented carrier volatiles and hot air withdrawn from the dryer through a catalytic converter to exothermically degrade the volatiles, and recycling at least a portion of heated effluent air exiting the catalytic converter by adding such effluent air to the hot air streams supplied to the dryer.

3. The process defined in claim 2 further comprising directing another portion of the heated effluent air exiting the catalytic converter through a heat exchanger; and directing the combined vented carrier volatiles and hot air from the dryer through the heat exchanger to add heat from the heated effluent air to the mixed volatiles and hot air before passing the preheated mixed volatiles and hot air through the catalytic converter.

4. The process as defined in claim 2 further comprising directing the portion of effluent hot recycled to an exhaust vent, controlling the exhaust flow of effluent with a bypass damper to adjust the proportion of effluent air from said catalytic converter which is exhausted and which is recycled.

5. The process defined in claim 2 further comprising, admitting fresh make-up air to the stream of hot air supplied to the dryer, sensing the air pressure within the dryer, and regulating the ratio of fresh make-up air to the volume of recycled heated effluent air from the catalytic converter in accordance with dryer pressure changes as a result of changes in exhaust fan speed.

6. The process defined in claim 5 comprising regulating the ratio to ensure that the lower flammability level of the volatiles is not exceeded.

7. The process defined in claim 5 further comprising regulating said ratio to ensure that a lower flammability level of 25% or less is attained.

8. The process defined in claim 2 further comprising measuring the temperature of the web in the dryer, and controlling the amount of heated effluent air from the catalytic converter recycled through the dryer in response to variations in the web temperature.

9. Apparatus for drying a web of paper or the like that has been wetted with a liquid toner dispersion comprising a volatile, flammable carrier liquid and solids toner particles, said apparatus comprising:

a dryer including a hot air supply manifold and means defining a dryer chamber around said manifold;

a supply conduit connected to said supply manifold for supplying hot air to said dryer;

conveyer means for moving the web along a path through said dryer chamber past said manifold whereby substantially all carrier liquid on the web is volatilized to mix in said dryer chamber with the hot air from said manifold;

means for suspending the web in an air cushion while the web is moved through said dryer chamber;

vent means connected to said dryer chamber for venting the mixture of hot air and volatilized carrier from said dryer chamber;

a variable speed exhaust fan connected to withdraw the mixture of air and volatilized carrier through said vent means;

means for measuring the content of volatilized carrier in said dryer chamber; and means responsive to said measuring means for regulating the speed of said exhaust fan to control the amount of mixture flowing through said vent means.

10. Apparatus as defined in claim 9 wherein said manifold includes a pair of air supply tubes connected to said conduit means and disposed in said dryer, the web path extending between said air supply tubes, said tubes each having a plurality of apertures therein aimed toward the web path, the hot air supplied to said air supply tubes exiting through said apertures to blow hot air onto opposite sides of the web to suspend the portion of the web passing between said tubes in said dryer.

11. Apparatus as defined in claim 9 further comprising catalytic converter means connected to receive the mixture from said fan for exothermically degrading the volatilized carrier, and recycle conduit means connecting the effluent from said catalytic converter means to said supply conduit for recycling at least a portion of hot effluent from said catalytic converter means to said supply manifold.

12. Apparatus as defined in claim 11 further comprising heat exchange means connected to said recycle conduit means whereby a portion of the effluent emanating from said catalytic converter means is passed to said heat exchange means, the flow of mixture from said fan being connected to said heat exchange means whereby the mixture of volatilized carrier and hot air from said dryer is brought into heat exchange relation with the hot effluent from said catalytic converter means thereby to preheat the mixture of hot air and volatilized carrier prior to passage thereof into said catalytic converter means.

13. Apparatus as defined in claim 12 further including an auxiliary heater connected between said fan and said recycle conduit means to preheat the mixture flowing from said fan during startup of the apparatus when said catalytic converter means is not fully operative.

14. Apparatus as defined in claim 9 further comprising a make-up air supply conduit connected to said manifold for supplying fresh air thereto, and damper means controlling the flow through said make-up air supply conduit for adjusting the amount of fresh air supplied to said manifold.

15. Apparatus as defined in claim 9 further comprising means for measuring the air pressure in said dryer chamber, and means for regulating the amount of make-up air admitted to said dryer in response to variations in chamber pressure sensed by said pressure measuring means as a result of changes in exhaust fan speed.

16. Apparatus as defined in claim 11 further comprising recycle damper means controlling the flow through said recycle conduit means for adjusting the amount of hot effluent from said catalytic converter means that is recycled to said air supply manifold.

17. Apparatus as defined in claim 16 further comprising means for measuring the temperature of the portion of the web in said dryer chamber, and means for controlling the amount of hot effluent recycled from said heat exchanger means to said supply mainfold in response to said temperature measuring means.

* * * * *

UNITED STATES PATENT AND TRADEMARK OFFICE

CERTIFICATE OF CORRECTION

PATENT NO. : 5,177,877

DATED : January 12, 1993

INVENTOR(S) : Mark F. Duchesne and Richard A. Gaspar

It is certified that error appears in the above-identified patent and that said Letters Patent is hereby corrected as shown below:

Column 10, Line 47, Claim 1, After "the" (second occurance) insert -- carrier volatiles in the dryer and regulating the speed of the --.

Column 11, Line 1, Claim 4, Change "hot" to --not--.

Signed and Sealed this

Ninth Day of November, 1993

*Attest:*

*Attesting Officer*

Bruce Lehman

BRUCE LEHMAN

*Commissioner of Patents and Trademarks*